US007270031B1

(12) United States Patent
Huls

(10) Patent No.: US 7,270,031 B1
(45) Date of Patent: Sep. 18, 2007

(54) LIGHT BULB TOOL

(76) Inventor: Donald W. Huls, 3988 Martin Dr., San Mateo, CA (US) 94403

( * ) Notice: Subject to any disclaimer, the term of this patent is extended or adjusted under 35 U.S.C. 154(b) by 0 days.

(21) Appl. No.: 11/477,075

(22) Filed: Jun. 27, 2006

(51) Int. Cl.
*H01K 3/32* (2006.01)
*B25B 13/48* (2006.01)
*B25B 33/00* (2006.01)

(52) U.S. Cl. ..... 81/53.11; 81/436

(58) Field of Classification Search ..... 81/53.11, 81/436, 437

See application file for complete search history.

(56) References Cited

U.S. PATENT DOCUMENTS 2,117,017 A * 5/1938 Chadsey ..... 81/53.11
5,103,695 A * 4/1992 Dolle et al. ..... 81/53.11
5,829,324 A * 11/1998 Secor ..... 81/53.11
6,739,219 B1 * 5/2004 Cuevas ..... 81/53.1

* cited by examiner

*Primary Examiner*—David B Thomas

(74) *Attorney, Agent, or Firm*—David E Newhouse, Esq.

(57) ABSTRACT

A light bulb tool is describe having a resilient conical bowl with an inwardly depending lip sized for frictionally engaging a globe end of a typical light bulb; a cylindrical element coaxially positioned penetrating through forming an apex of the resilient conical bowl having a proximal end extending exterior the bowl presenting a central socket for connecting with a male driver handle for rotating the tool coaxially relative to light bulb fixture sockets, and a distal end extending into the conical volume of the bowl presenting outwardly flaring reaming teeth diametrically sized for engaging interior annular wall surfaces of bases of broken light bulbs, spaced sufficiently below the lip of the cup for allowing the depending lip of the bowl to frictionally engage a larger diameter globe end of an intact light bulb. The cylindrical element preferably includes a collar presenting two exterior annular shoulders spaced downward from the reaming teeth around which the resilient conical bowl is coaxially journaled between the spaced exterior annular shoulders allowing the bowl to resiliently flex downward against and around the lower shoulder of the collar when the reaming teeth of the cylindrical element are pushed into engagement within a base of a broken light bulb socket compressing the conical bowl against any surrounding light bulb fixture socket mounting surface.

2 Claims, 7 Drawing Sheets

LIGHT BULB TOOL

BACKGROUND OF THE INVENTION

1. Field of the Invention

The invention is a light bulb tool for removing light bulbs and bases of broken light bulbs from lighting fixture bulb sockets.

2. Description of the Prior Art

Since the development and commercialization of light bulbs featuring an incandescent filament isolated within an evacuated glass bulb electrically connected to an external electrical power source via a screw in base in the 1880s [See U.S. Pat. No. 223,898, Edison], tools have been evolving for removing both intact light bulbs and the bases of broken light bulbs from sockets into which they have been screwed or inserted. [See U.S. Pat. Nos. 1,288,273, & 1,319,028, Grinnell; 2,117,017, Chadsey; 4,663,996, Grudgefield et al; 5,829,324, Secor; and 6,983,675, Scearce.]

SUMMARY OF THE INVENTION

The invented light bulb tool includes a resilient conical bowl with an inwardly depending lip sized for frictionally engaging a globe end of a typical light bulb; a cylindrical core element coaxially positioned penetrating through forming an apex of the resilient conical bowl having a proximal end extending exterior the bowl presenting a central socket for connecting with a male driver handle for rotating the tool coaxially relative to light bulb fixture sockets, and a distal end extending into the conical volume of the bowl presenting outwardly flaring reaming teeth diametrically sized for engaging interior annular wall surfaces of bases of broken light bulbs, spaced sufficiently below the lip of the bowl for allowing the inwardly depending bowl lip to frictionally engage the globe surface of an unbroken bulb.

A novel aspect of the invented light bulb tool relates to a collar disposed around the cylindrical element presenting two exterior annular shoulders spaced downward from the reaming teeth around which the resilient conical bowl is coaxially journaled between the spaced exterior annular shoulders allowing the bowl to resiliently flex downward against and around the lower shoulder of the collar when the reaming teeth of the cylindrical element are pushed into engagement within a base of a broken light bulb socket compressing the resilient, conical bowl against any surrounding light bulb fixture socket mounting surface. The flexed bowl captures glass fragments and pulverized epoxy resulting from gouging and engagement of the reaming teeth of the tool with the interior walls of the bulb base.

DESCRIPTION OF PREFERRED AND EXEMPLARY EMBODIMENTS

Figure 3:
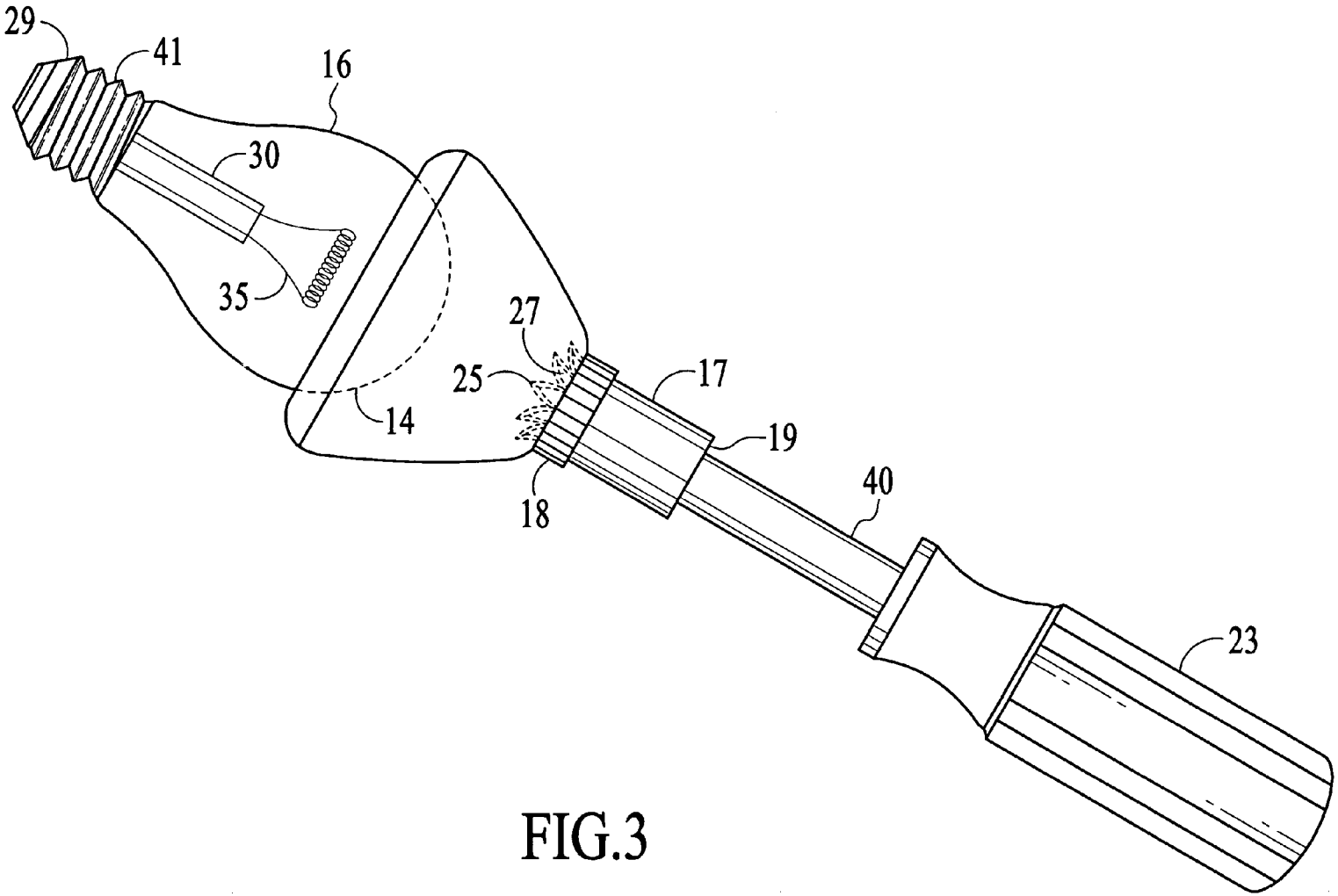
FIG. 3 is a perspective view showing the relationship of an intact light bulb and the invented light bulb tool.
Figure 4:
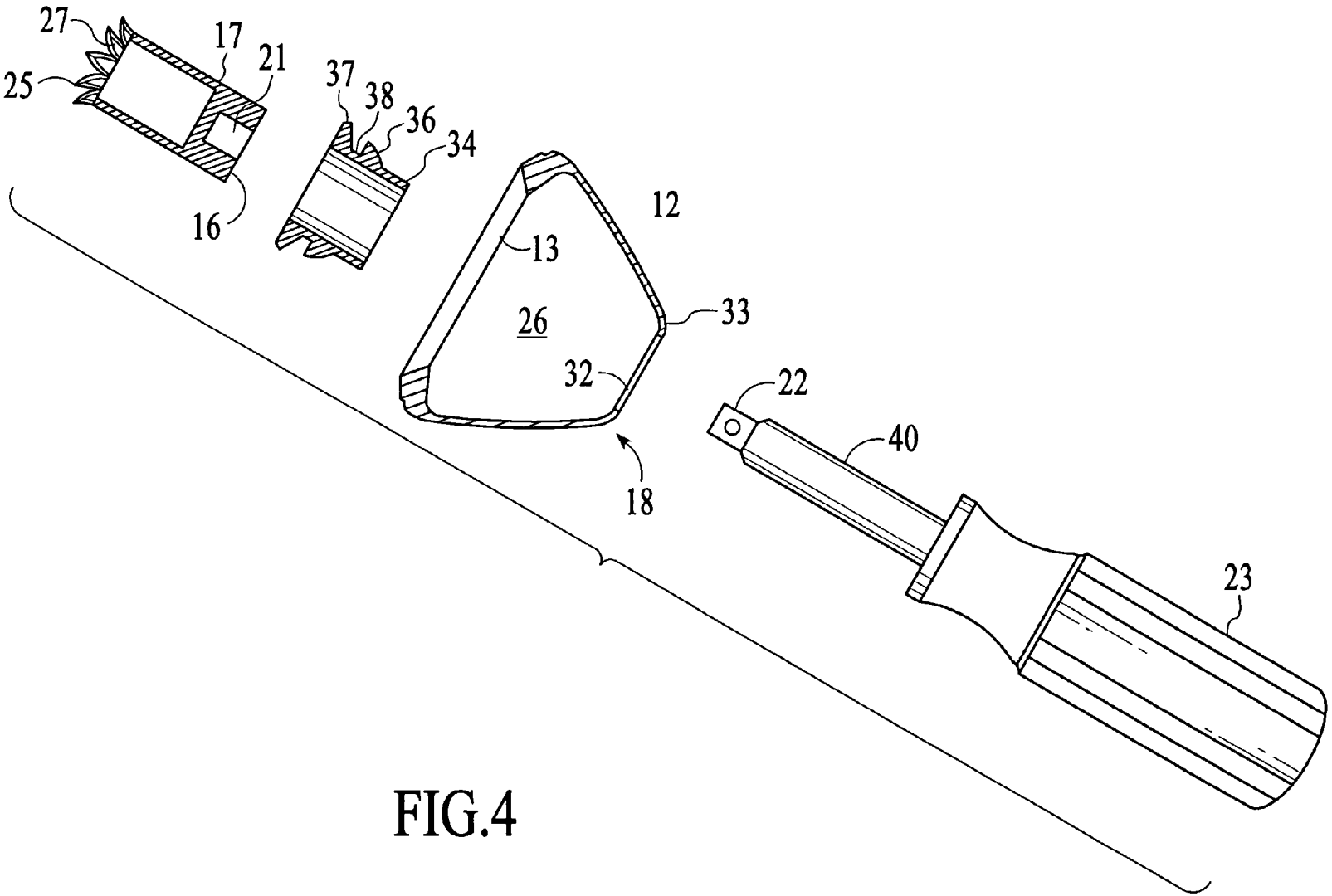
FIG. 4 is an exploded cross-section view showing the elements of the invented light bulb tool.
Figure 5:
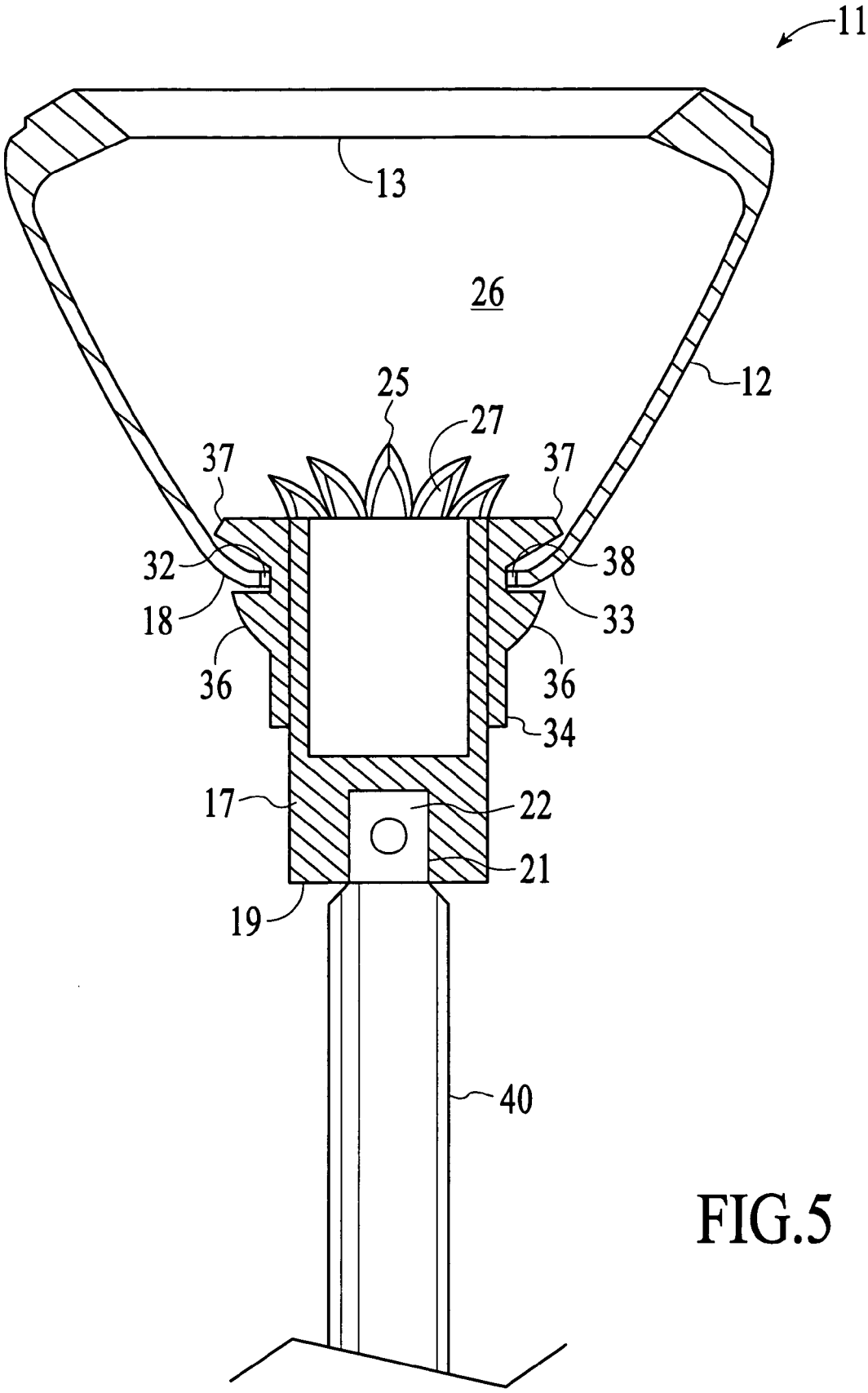
FIG. 5 is an enlarged cross-section view of the invented light bulb tool.

Looking at the figures the essential components of the invented light bulb tool 11 are a resilient conical bowl 12 with an inwardly depending lip 13 sized for frictionally engaging a globe end surface 14 of a typical light bulb 16, and a cylindrical core element 17 coaxially positioned penetrating through forming an apex 18 of the resilient conical bowl 12 having a proximal end 19 extending exterior the bowl 12 a central receiving socket 21 for connecting with a male driver socket head 22 and handle 23 for rotating the tool 11 coaxially relative to light bulb fixture sockets 24 (FIGS. 3, 6A & 6B), and a distal end extending into the conical volume 26 of the bowl 12 presenting outwardly flaring reaming teeth 27 diametrically sized for engaging interior annular wall surfaces 28 within bases 29 of broken light bulbs 31 at or just below junction of the sealant epoxy at the top of the metal the base cup. As shown in FIG. 3, the sharp tips 25 of the outwardly flaring reaming teeth 27 of the cylindrical core element 17 are spaced sufficiently below the inwardly depending lip 13 of the bowl 12 for allowing the depending bowl lip 13 to frictionally engage the globe end surface 14 of an unbroken bulb 16. FIGS. 4 and 5 show the components of a preferred embodiment of the invented light bulb tool 11 further including a resilient collar 34 into which the cylindrical core element 17 is inserted that provides an annular seating channel 38 for securing the bowl 12 at its apex 18 around the cylindrical core element 17.

The cylindrical core element 17 is preferably composed of a durable, hard, structural material, e.g. tool steel, that can be worked for presenting sharp, outwardly flaring reaming teeth 27 at its distal end capable of gouging into the softer metals 41 forming, and epoxy sealants 42 within, sealing typical light bulb bases 29. The length of the cylindrical core element 17 should be chosen such that its volume and length accommodates the glass stem 30 or fragments 47 of a broken stem (FIG. 6B) within a typical light bulb 16 that support the bulb filament 35. (See FIGS. 6A & 6B.) The resilient conical bowl 12 with depending lip 13 is an integrally formed piece, of rubber, silicone rubber, latex or similar resilient and flexible elastomer such as Butyl Rubber having a hole 32 coaxially penetrating though its base 33.

The bowl 12 is secured around the cylindrical core element 17 by a resilient exterior collar 34 composed of a similar elastomer into which the cylindrical core element 17 is inserted. The collar 34 presents two exterior annular shoulders 36 & 37 defining an annular seating channel 38 for receiving the circumferential edge of the hole 32 through the base 33 of the bowl 12. Preferably the hole 32 through the base 33 is slightly smaller in diameter than the annular channel 38 of the collar 34 when mounted around the cylindrical core element 17, so that the hole circumferentially stretches to resiliently seat in the annular seating channel 38.

Figure 1:
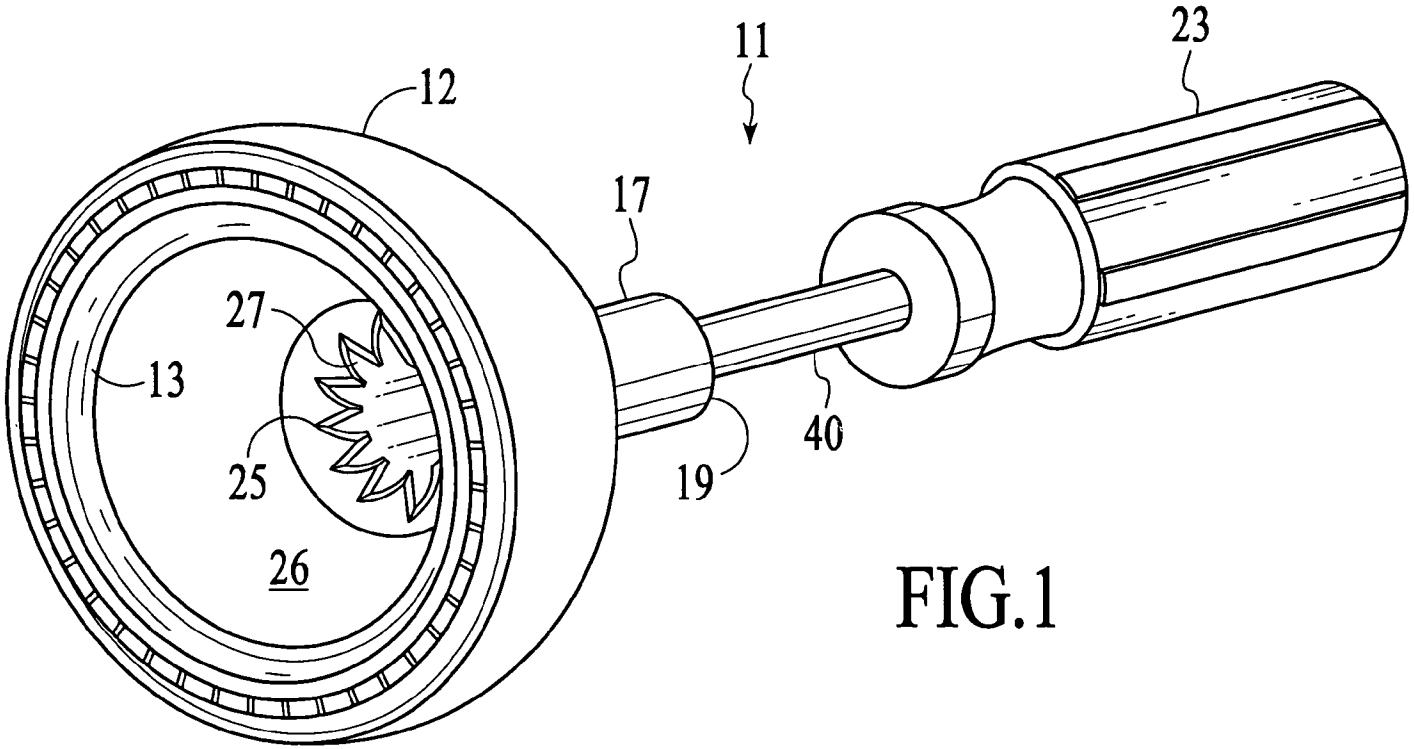
FIG. 1 is a perspective presentation of the invented light bulb tool.
Figure 2:
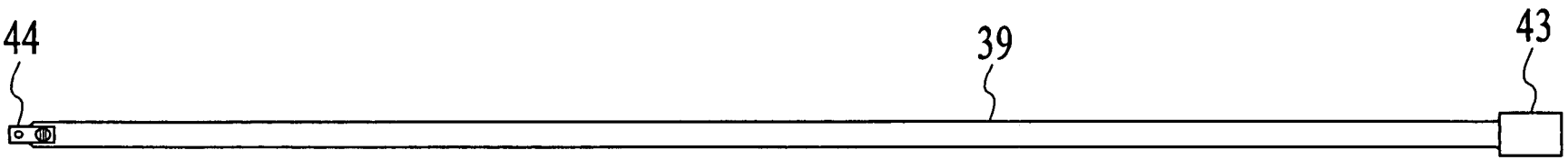
FIG. 2 illustrates and extension rod for the male driver-handle having male driver socket head at one end and a female receiving socket at the other end.

The proximal end 19 of the of the cylindrical core element 17 presents a conventional ball-detent receiving socket 21 for receiving a conventional male ball-detent driver head 22 at the end of a driver rod 40 extending from a handle 23. An extension driver rod 39 (FIG. 2) with a conventional ball-dent socket 43 at one end and a conventional ball detent driver head 44 at its opposite end allows reach of the invented light bulb tool to be increased by connecting rod 39 between the driver head 22 of the handle rod 40 and the ball-detent socket 21 of cylindrical core element 17.

Figure 6A:
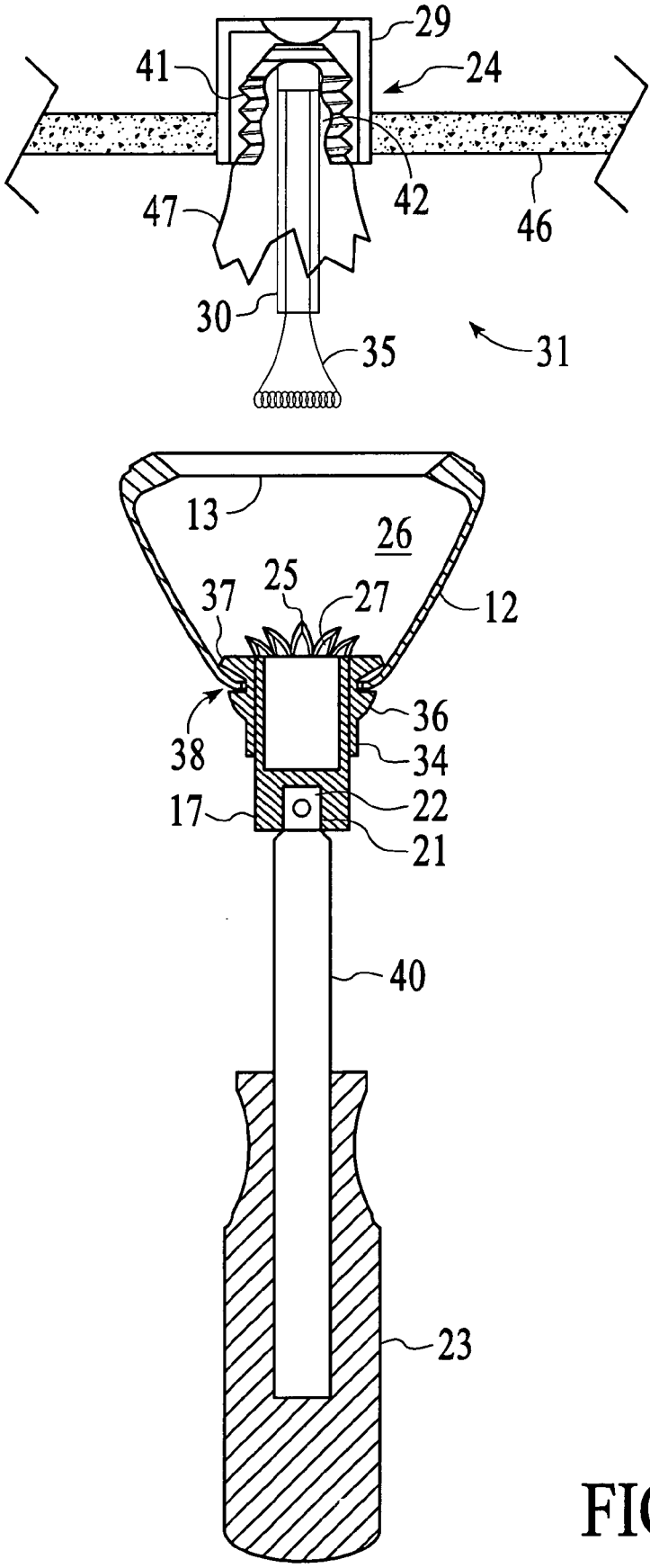
FIGS. 6A and 6B present a cross-section views illustrating desired functional features of the invented light bulb tool for removal of a broken light bulb base from a light bulb socket.
Figure 6B:
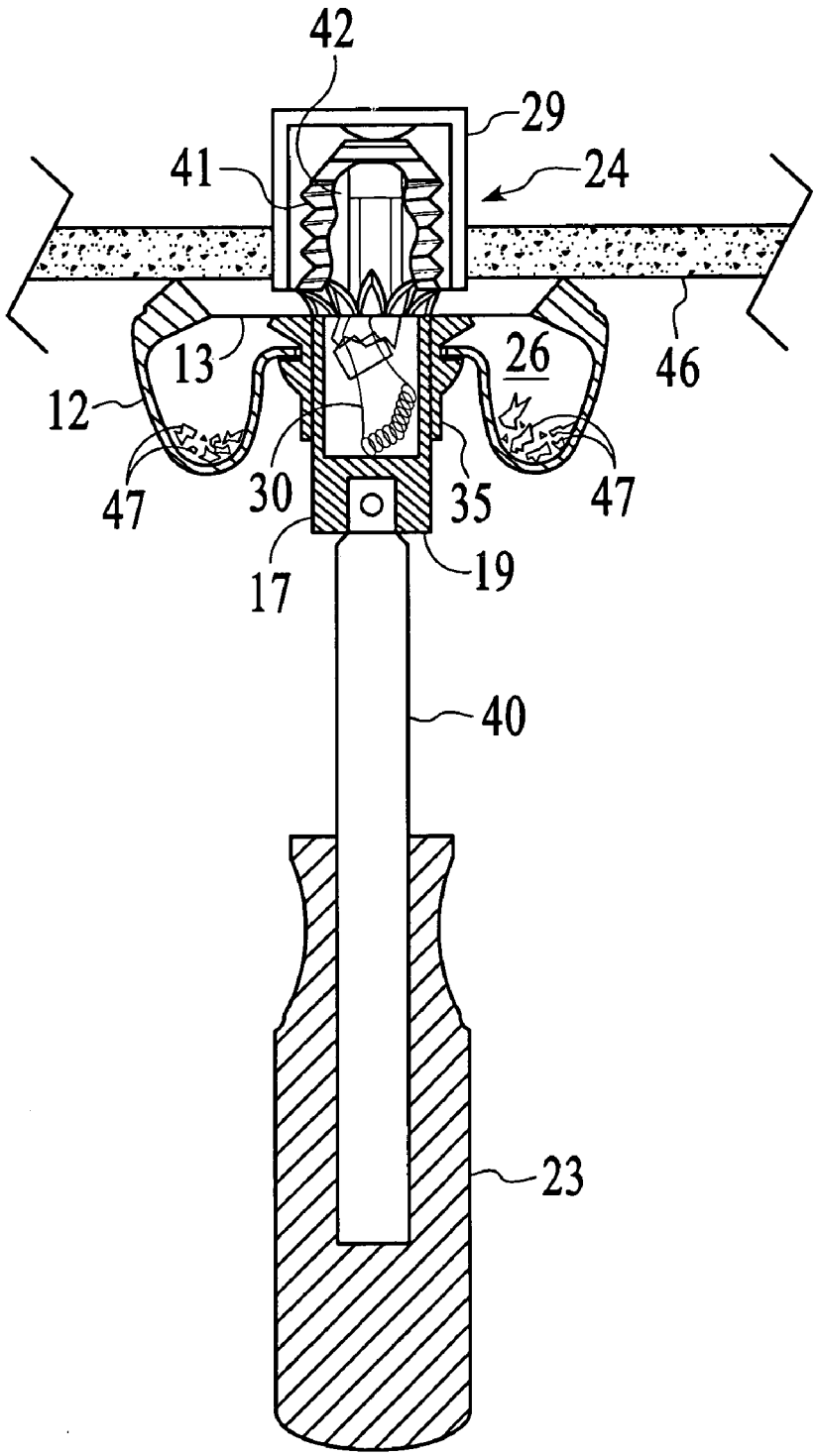
Figure 7:
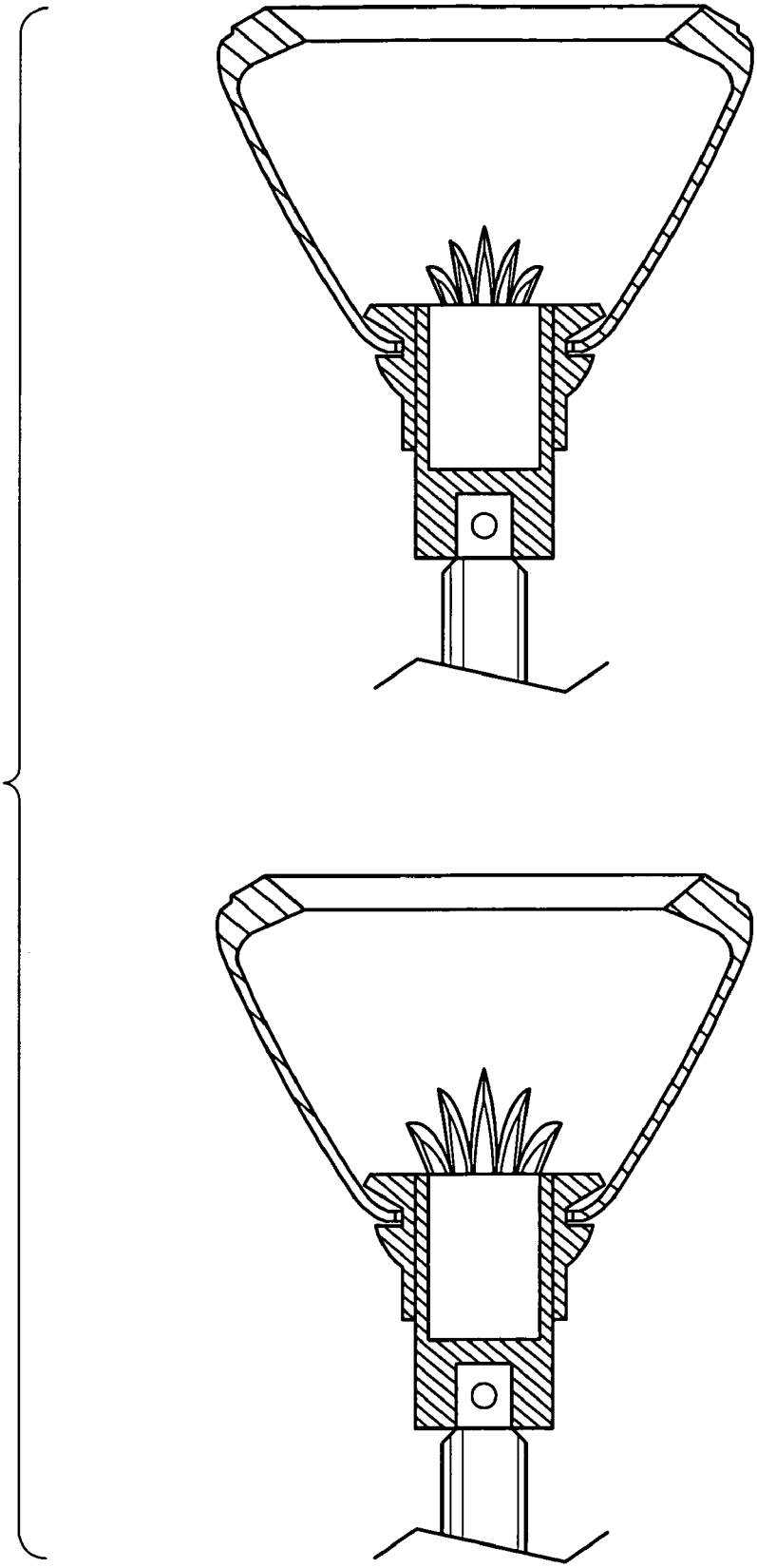
FIG. 7 present cross-section views of 2 sizes of the invented light bulb tool

FIGS. 3, 6A & 6B illustrate how to use the invented light bulb tool 11 for removing and intact light bulbs (FIG. 3) and broken light bulbs 31 (FIG. 6B) from screw-in threaded bulb sockets. It should be appreciated the invented light bulb tool 11 is equally functional for removing broken light bulb bases inserted into and anchored by anchored by protruding bayonets received within slots/channels of typical bayonet light bulb sockets.

The tool designer should appreciate that the combination of the resilient flexible bowl 12 and collar 34 comprises a compound structure that not only allows for flexure of the bowl walls within the elastic limits of the particular bowl material when the bowl is collapsed (i.e., when the reaming teeth 27 of the core element 17 are pushed into engagement within a light bulb base 29 and the tool is twisted for rotating the base 29 from the light bulb socket 24) but also minimizes the force, hence friction between the bowl top an any surface 46 surrounding the light bulb socket 24. It should also be appreciated that the compound structure allows for glass fragments 47 and debris collecting within the bowl volume 26 to be easier emptied by removing the bowl 12 from around the collar 34 and shaking the fragments 47 out the hole 32 though the base 33 of the bowl 12, rather than contending with the depending bowl lip 13 that will tend to trap and retain the fragments 47 and debris within the bowl volume 26.

It should be appreciated that many modifications and variations of the essential elements of the invented light bulb tool can be made both with respect to the particular tools described and other analogous tools which, while not described above, will fall within the spirit and scope of the invention as defined in the appended claims.

I claim:

1. A light bulb tool comprising in combination, a) a resilient, conical bowl with an inwardly depending lip sized for frictionally engaging a globe end of a light bulb;

b) a cylindrical element coaxially penetrating through, forming an apex of the resilient conical bowl having a proximal end extending exterior the bowl presenting a central socket for connecting with a male driver handle for rotating the tool coaxially relative to light bulb fixture sockets, and a distal end extending inside the bowl presenting outwardly flaring reaming teeth diametrically sized for engaging interior annular wall surfaces of bases of broken light bulbs, the reaming teeth being spaced sufficiently below the depending lip of the bowl for allowing the depending lip of the bowl to frictionally engage the globe end of an intact light bulb.

2. The light bulb tool of claim 1 wherein the cylindrical element further includes an exterior collar presenting two exterior annular shoulders spaced downward from the reaming teeth, and the resilient, conical bowl is coaxially journaled around the collar between the spaced exterior annular shoulders, whereby the bowl resiliently flexes downward against the lower shoulder of the collar when the reaming teeth of the cylindrical element are pushed into engagement within a base of a socket of a broken light bulb compressing the resilient, conical bowl against any surface surrounding a particular light bulb fixture socket.

* * * * *